United States Patent [19]

Drits et al.

[11] Patent Number: 4,602,459

[45] Date of Patent: Jul. 29, 1986

[54] SYSTEM FOR ACTIVE ERROR COMPENSATION DURING MACHINING

[75] Inventors: Vladimir Drits, Crystal; Yevsey Gutman, Minneapolis, both of Minn.

[73] Assignee: Mar Engineering, Inc., Crystal, Minn.

[21] Appl. No.: 701,927

[22] Filed: Feb. 15, 1985

[51] Int. Cl.[4] ..... B24B 49/00

[52] U.S. Cl. ..... 51/165.77; 51/165.75; 51/165.92; 403/291

[58] Field of Search ..... 51/165.77, 165.74, 165.75, 51/165.76, 165.92, 165.93, 163.1; 308/2 A

[56] References Cited

U.S. PATENT DOCUMENTS

| | | | |
|---|---|---|---|
| 2,600,550 | 6/1952 | Levesque | 51/165 |
| 2,880,407 | 3/1959 | Comstock | 340/199 |
| 3,081,552 | 3/1963 | Reason | 308/2 A |
| 3,100,954 | 8/1963 | DiLella | 51/165.77 |
| 3,267,620 | 8/1966 | Dayton | 51/163.1 |
| 3,456,394 | 7/1969 | Welsh | 51/165.77 |
| 3,554,064 | 1/1971 | Skillen | 82/14 |
| 3,665,652 | 5/1972 | Gordon | 51/165.71 |
| 3,897,660 | 8/1975 | Chijiiwa | 51/165.92 |
| 3,916,571 | 11/1975 | Seidel | 51/101 R |
| 3,957,316 | 5/1976 | Armitage | 308/2 A |
| 3,967,515 | 7/1976 | Nachtigal | 51/165.92 |
| 4,095,377 | 6/1978 | Sugita | 51/165.93 |
| 4,140,998 | 2/1979 | Bettle | 340/199 |
| 4,229,909 | 10/1980 | Dial | 51/165.75 |
| 4,251,760 | 2/1981 | Gersch | 318/604 |
| 4,419,612 | 12/1983 | Reda et al. | 318/571 |
| 4,425,061 | 1/1984 | Kindl | 408/16 |
| 4,441,103 | 4/1984 | Urabe | 340/680 |

*Primary Examiner*—Harold D. Whitehead

*Attorney, Agent, or Firm*—Kinney & Lange

[57] ABSTRACT

A control system for precision machine tools and similar devices provides a precise position during active operations on a table supported workpiece or part. The present system provides a support table on which a machine part or specimen is mounted that is controlled in its position through a friction free spring type hinge relative to a base, and which is held therein with a piezoelectric actuator operated in an active closed loop system to maintain a set position without any backlash.

18 Claims, 6 Drawing Figures

SYSTEM FOR ACTIVE ERROR COMPENSATION DURING MACHINING

BACKGROUND OF THE INVENTION

1. Field of the Invention

The present invention relates to position control devices and in particular active control positionable tables used for precise positioning of parts that are being machined or worked on.

2. Description of the Prior Art

In grinding and machining operations which require precise positioning, various tables have been advanced for use. Generally speaking the present tables comprise slides which are difficult to monitor precisely and difficult to maintain in a precise position due to backlash in the mounting. For example, U.S. Pat. No. 4,229,909 shows a tool grinding machine which has a support table which will slide in and out relative to the grinding wheel and also can be rotated about a pivot. A spring is controlled for maintaining a load on the tool grinding machine in an axial direction, but it does move a sliding connection which will cause backlash, and it does not include means for an active control of a table that has a friction free pivot for the table.

U.S. Pat. No. 3,916,571 shows a cam controlled machine tool for machining parts of various configurations. While it includes a typical control system having thumb wheel input switches and digital controls for providing an output, the programming does rely upon cams for moving the support table in a desired path of movement to produce the contour that is needed in the completed part.

U.S. Pat. No. 4,425,061 is a tool setting device for a machining center utilizing numerical controls, and a gauge unit using detectors for providing position signals, and for indicating arrival of the tool at a desired location. Thus, the device shows a control with feedback signals, but does not include a part support table operating on a friction free pivot as with the present device.

U.S. Pat. No. 4,419,612 illustrates a electromechanical internal grinding machine for controlling slides for feeding parts into a grinding machine. Screw actuators are used for transmitting the control commands, which again have backlash, and the use of backlash free mounting supports for the work table is not disclosed.

U.S. Pat. No. 4,441,103 shows a vibration sensing transducer for machine tools, which is a piezoelectric vibration detecting member having suitable controls for stopping the rotation or travel of a tool and causing the feed of the workpiece to stop if an unusual vibration is sensed. It also provides a way of utilizing a rapid infeed, which will change instantly to a more satisfactory grinding feed rate.

U.S. Pat. No. 4,251,760 shows a gauging and tool control system for production of identical parts utilizing a closed loop feedback control, but it does not include a table of the type that has a friction free support hinge. It does, however, show a typical prior art control system for controlling motions of a machine tool.

U.S. Pat. No. 3,665,652 is a control system for a grinder that has a sensor for generating a signal that represents the dimensional characteristics of the workpiece and has means for providing signals indicating the rate of removal of material from the workpiece. It is not used in connection with a table that controls the position of the workpiece precisely with respect to a reference surface of the grinding wheel or tool that is being used.

U.S. Pat. No. 4,140,998 shows a high accuracy position indicator using an LVDT as a position transducer and in particular relates to circuitry with two position rectifiers to cancel out the effects of input voltage frequency fluctuation. This, again, shows a typical existing LVDT application, and relates to providing a very high accuracy LVDT.

U.S. Pat. No. 2,600,550 illustrates a taper control indicator for controlling a grinder which is a manual adjustment system using a visual display in substantially different sensing elements than that used with the present device.

U.S. Pat. No. 3,554,064 shows a system utilizing a thermally insensitive element, such as a rod which is anchored at one end to a body and a strain guage controlled heater or cooler that brings the temperature of the controlled device to a value which results in maintenance of a predetermined length of the part. A slide, is again used, which has backlash in its mounting.

An electronic swivel control is shown in U.S. Pat. No. 2,880,407, and this device does include a pivoting device using a conventional pivot that does have backlash. In addition, the device is used only for setting the position before or at the start of a machining process and does not provide active adjustment or control during machining.

Thus, in the prior art, the problems of providing a precise active control system exist in the machine tool industry.

SUMMARY OF THE INVENTION

The present invention relates to a control system for precisely controlling the position of a member supported on a table relative to a base and doing so with a closed loop control using frictionless and backlash free supports. A table is adapted for use with machine tools, such as grinders, and the backlash free table hinge is made through a flat spring support system. The position is controlled by a suitable actuator, as shown, a piezoelectric actuator including a feedback sensor for precisely maintaining the piezoelectric actuator position and thus the table position once the desired position has been reached. Suitable controls are used in a feedback system, which uses components readily available for closed loop control.

The key to the precise control resides in the use of backlash free supports for the position controlled portion of the support table and a feedback sensor for maintaining the desired position.

DETAILED DESCRIPTION OF THE PREFERRED EMBODIMENT

Figure 1:
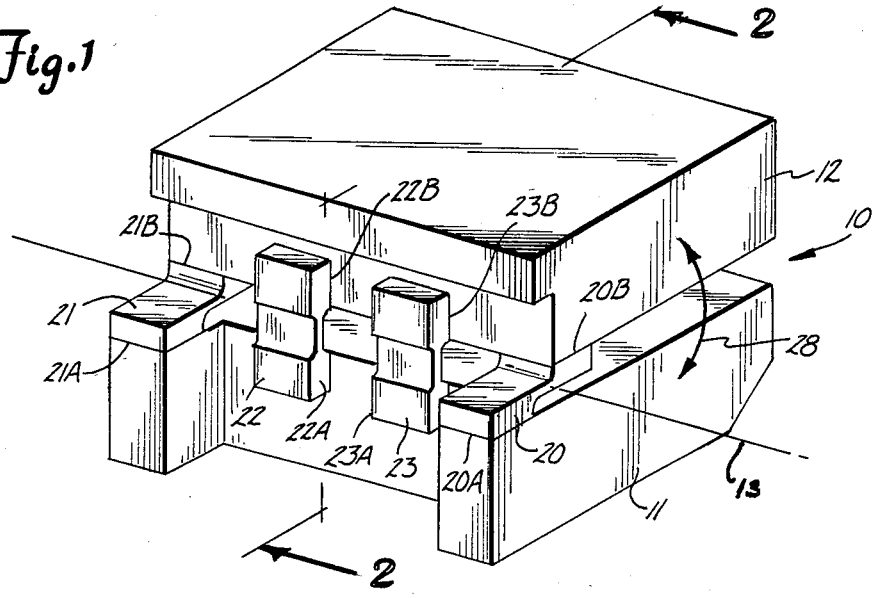
FIG. 1 is a perspective view of a typical support table used with the system of the present invention showing the hinge members used.

The present invention is shown in its preferred form in FIG. 1, and the concept of the frictionless and backlash free hinge for supporting a workpiece table is illustrated.

The table assembly indicated generally at 10 includes a table base 11, which will be shown as fixed relative to a machine tool base, and a support table 12. The table base 11 and the table 12 are hingedly connected together about hinge members forming a hinge axis illustrated schematically at 13 that comprises the center lines of intersection of two mutually perpendicular flexure or flat spring assemblies.

As shown, a first spring flexure member 20 is mounted at one side of the base and at one end thereof, as shown at 20A, and at its opposite end 20B the spring 20 is fixedly mounted to the table 12. The plane of the spring is parallel to the upper surface of the table 12, which is the workpiece support surface. A second flat spring 21 is positioned at the opposite end of table 12 from spring 20. Spring 21 has one end 21A fixed to the table base 11, and the opposite end, shown at 21B, is fixed to the undersurface of the table 12. The spring 21 and the spring 20 are coplanar, that is the center plane of the spring 21, and the center plane of the spring 22 are coplanar.

The center portions of the springs 20 and 21 are flexible and form hinges. The pivoting about the axis 13 is controlled through the use of two additional flat springs indicated at 22 and 23, which are positioned between the springs 20 and 21, and the springs 22 and 23 have first ends 22A and 23A, respectively, attached to the table base 11 and second ends 22B and 23B attached to a side surface of the table 12. The center planes of these springs 22 and 23 at rest are coplanar, and perpendicular, when all the springs are at a rest position, to the planes of the springs 21 and 22. The line where the two perpendicular planes of the springs intersect forms the hinge axis 13. The plane of the springs 22 and 23 is shown at 25 in FIG. 2, and the plane of the springs 20 and 21 is shown at 26.

Thus it can be seen that the table 12 can hinge relative to the table base 11 about the axis 13, and that this forms a stable, frictionless, backlash free hinge pivot. The table is very stable and resists forces tending to twist the table 12 relative to the table base 11 about an upright axis, and is very rigid except in the single degree of freedom comprising the movement of pivoting about the axis 13 indicated by the arrow 28 in FIG. 1.

The position of the table 12 about the axis 13 is controlled through the use of an actuator 30, as shown a piezoelectric actuator, which has a housing 31 that forms a reference supported relative to the table base 11. As shown the actuator 30 is positioned in a suitable receptacle formed in table base 11, and an actuator button or plunger 32 extends from the actuator. The axial position of the actuator plunger 32 is controlled by applying a voltage to the piezoelectric actuator causing the actuator plunger 32 to shift axially slightly relative to the base end of the housing 31. The amount of shifting or movement of the plunger is quite small, and the position can be precisely controlled by regulating the voltage applied to the actuator. The actuator also is capable of carrying high loads tending to compress it.

A feedback sensor, as shown an LVDT indicated at 33, is also mounted directly on the base 11 adjacent actuator 30, and has a sensing plunger 34 that senses the spacing or position of the under surface of table 12 relative to the table base 11, and provides an output signal in a known way that comprises a feedback signal indicating pivotal shifting of the table 12 about axis 13. The LVDT is used to provide a closed loop control for maintaining the plunger 32 at a desired level. Adjusting the voltage to the piezoelectric actuator 30 in response to the feedback signal when the table 12 shifts about the backlash free pivot axis 13 provides the closed loop control needed for maintaining the table precisely positioned.

A spring 35 is used for urging the table 12 toward the table base 11, and against the actuator plunger 32, to prevent the table 12 from pivoting upwardly.

In the form shown, the table base 11 is fixed onto a tool base slide 40 which can be mounted on suitable ball bearings 41 relative to a tool base 42. The slide 40 can be controlled for movement along the length of the grooves 41A for the ball bearings 41 and thus can be moved along a plane parallel to the table surface in a desired manner. The table 12 will also move as the slide 40 moves.

A workpiece indicated generally at 43 is supported on the top surface of the table in any desired manner, and is held adjacent a machine tool element, in the form shown a grinder wheel 44 that is mounted on a spindle 45 relative to the tool base 42. The axis of rotation of the spindle 45 is indicated at 46, and movement about the frictionless hinged pivot 13 of the table 12 will cause shifting of the workpiece 43 in direction along this axis, so that the position of the workpiece relative to the grinding wheel is controlled by the actuator 30 and the actuator plunger 32. The tool base 42 is capable of being moved along its axis 46A through the use of a suitable actuator 50 in a conventional manner (or manually), or alternately, the spindle 45 can be moved relative to this tool base 42 to bring the workpiece toward and away from the grinding wheel 44 in direction of the axis 46.

The position of the table 12 in direction toward and away from the grinding wheel 44 is sensed through the use of a suitable LVDT sensor 47 that is mounted on the machine tool base upright member (or spindle assembly) 42A, and has a sensing plunger 48 that engages the rear surface 49 of the table 12 to determine when the table 12 is positioned adjacent to the grinding wheel 44.

The control system is shown only schematically, because the controls can be of any desired form. An actuator represented at 50 for the coarse adjustment of the tool base 42 relating to the spindle assembly 42A is shown. A control signal line 51 provides a signal from the LVDT sensor 47 to one input of a differential amplifier 52 having a set point potentiometer 53 connected to the other input. The amplifier 52 compares the set point with the signal from the LVDT 47 to determine if the grinding wheel 44 is in a desired position relative to the table 12, and if there is an error, a signal is provided along a line 54 to a suitable processor 55 of conventional design which will provide a feedback signal 56 to drive the actuator 50 to its desired position for initial table position.

The final positioning of the workpiece 43 and the table 12 is accomplished by adjusting the piezoelectric actuator 30. This is done by closed loop control utilizing a second set point signal from a suitable set point input 60, to a controller 61 which is essentially a comparator properly scaled which receives a signal along a line 62 from the processor indicating the table 12 is in proper position adjacent the grinding wheel 44. The controller 61 provides a voltage signal which is a function of the set point signal and signal on line 62 to the piezoelectric actuator 30 along a line 63 to maintain control. A feedback signal along a line 64 to the controller 61 comes from the LVDT 33, and any deviation of the table 12 from its desired position as sensed by LVDTs 33 and 47 will provide an error signal to change the voltage along line 63 and precisely set the table 12 by extending or retracting very slightly the plunger 32 of the piezoelectric actuator 30.

A command control system 66 can be used for providing the necessary inputs to accommodate different size workpieces in a normal manner. The controls can be microprocessor based or analog controls.

The piezoelectric actuator 30 is preferred because of the precise control possible for controlling the table 12. One micro inch tolerance of table movement can be achieved by the piezoelectric actuator 30 acting to support a table hinged as shown.

The control system and controller are essentially conventional controls that provide for closed loop inputs, and apart from processing the signals from the feedback LVDT 33 to insure that the piezoelectric actuator 30 is extended or retracted to maintain a desired position determined by a set point and command signal 62 from processor 55, any type of control can be utilized.

The friction free pivot formed along the axis 13, as well as the stability achieved with the crossed flexible spring hinge members for hinging the table permit the precise closed loop control.

Figure 3:
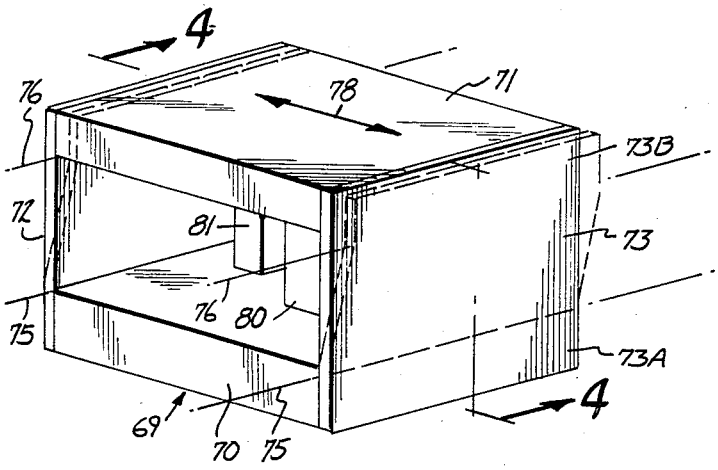
FIG. 3 is a perspective view of a modified form of the table of the present invention.

A second form of the invention shown in FIG. 3 includes a table assembly 69 having a table base 70, that would be mounted onto a machine table or in any desired location, and a table 71 that is supported relative to the table base 70 through a first flat flexible planar type spring hinge member 72, and a second planar type spring hinge member 73. The hinge members are generally flat springs made of size so that they extend along the length of the opposite end surfaces of the table base 70 and table 71, as shown at 73A and 73B. The same connections would be made for the spring 72.

The springs 72 and 73 act as parallelogram links supporting the table base 70 and table 71 parallel and provide a flexible, backlash free hinge action. When the table 71 moves to its dotted line position as shown in FIG. 3, the springs 72 and 73 each bend along two parallel axes as shown at 75 and 76, respectively. The hinge axes 75 and 76 are parallel and as the table 71 moves as indicated by the double arrow 78, the height of the table 71 will change because of the parallel link hinge action caused by the springs.

Figure 4:
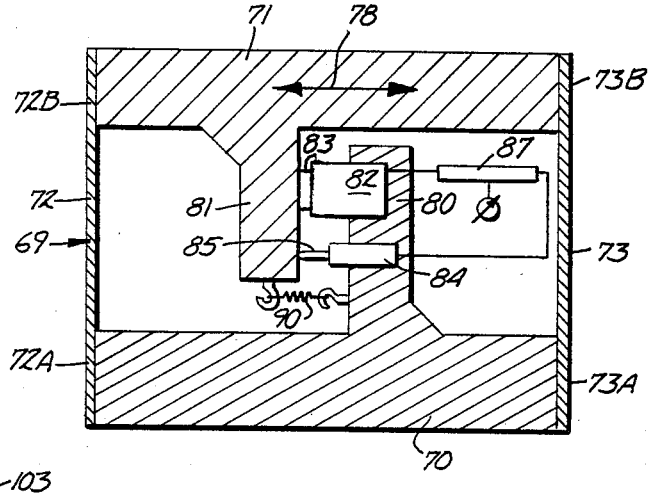
FIG. 4 is a sectional view taken on line 4—4 in FIG. 3.

As shown in FIG. 4, movement in direction along arrow 78 is controlled by providing a pedestal 80 integral with the table base 70, and a reaction wall 81 integral with the table 71. A piezoelectric actuator indicated at 82 is mounted in a suitable mounting receptacle formed on the pedestal 80. The piezoelectric actuator 82 has a plunger 83 that is controlled as to the amount of its extension or movement in the same manner as the previously described piezoelectric actuator by adjusting the voltage applied thereto. A feedback LVDT indicated at 84 is also mounted on the pedestal 80 and has a plunger 85 that senses the position of the reaction wall 81. The plunger 83 of the piezoelectric actuator bears against this reaction wall, and maintains it in a desired location. A spring 90 is connected between the pedestal 80 and the reaction wall 81 to urge the reaction wall 81 toward the pedestal 80.

Shifts in table position due to shifts in the actuator 82, which occur due to voltage drift or a drift with time, are corrected by the sensing of this movement through the LVDT 84. A feedback signal is provided from the LVDT through suitable comparator controls 87 to change the voltage on the piezoelectric actuator to restore the table to its original position even after very slight shifts.

Figure 5:
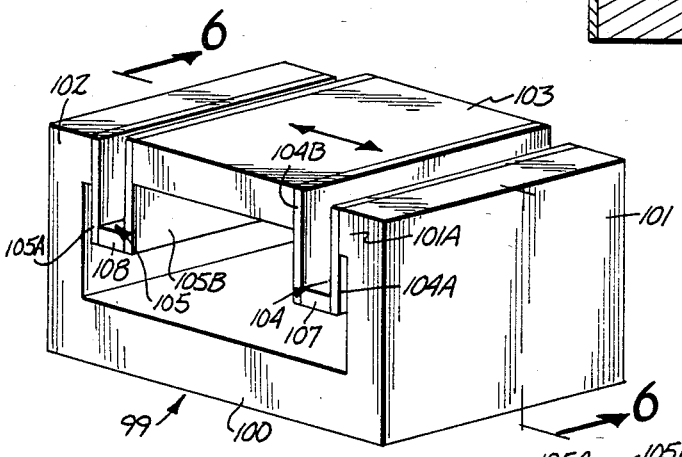
FIG. 5 is a perspective view of a further modified form of the table of the present invention.
Figure 6:
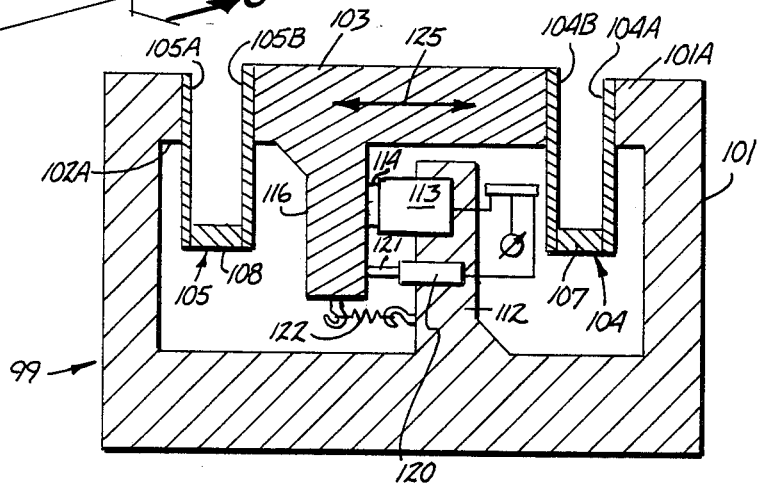
FIG. 6 is a sectional view taken as on line 6—6 in FIG. 5.

A further modified form of the invention is shown in FIGS. 5 and 6. The table assembly 99 comprises a table base 100 that has upright end walls 101 and 102, respectively. A table 103 is positioned between these end walls and each end of the table 103 is supported relative to one of the end walls through one of a pair of parallel flat spring assemblies indicated generally at 104 and 105. The spring assembly 104 includes flat springs 104A and 104B, that are connected together at their lower end with a connecting block 107 and their upper ends are connected to a lug 101A on the end wall 101 of table base 100 and an end edge surface of the table 103, respectively. The springs 105A and 105B of spring assembly 105 are connected to a lug 102A of the end wall 102 of the table base and the opposite end edge surface of the table 103, respectively. A connecting block 108 is used for supporting the springs 105A and 105B relative to each other at their lower ends.

In the space between the upright end walls 101 and 102, table base 100 has an upright pedestal 112 fixed thereto that supports a piezoelectric actuator 113, having a plunger 114 that engages a reaction wall 116 depending from the table 103. The piezoelectric actuator 113 is of the form previously described, and the table lateral position is sensed by an LVDT 120 mounted on the pedestal 112 and having a sensing plunger 121 that engages the surface of the reaction wall 116. A suitable spring 122 is used for urging the reaction wall 116 toward the pedestal 112. This movement as indicated by the arrow 125 is through the parallel spring assemblies 104 and 105, and as the table 103 tends to move in these directions, the movement is through frictionless pivot or hinge type supports on the spring assemblies. The individual springs act as parallelogram members and each spring set or assembly acts as a parallelogram relative to the other spring set. The pivot axes for the frictionless bending of these support members are along axes parallel to the table surface and located immediately below the attachment points of the respective springs to the edges of the table and just below the lug portions 101A and 102A on the end walls 101 and 102 of the table base 100.

Thus in all forms of the invention, movement of the table relative to a table base is controlled by a very precisely operated piezoelectric actuator, and the table is mounted relative to a table base which can be fixed in a desired location or mounted onto another movable slide and tool base on a machine tool.

The exact position of the tables as supported relative to the respective table bases in the translation directions permitted by the hinge supports can be determined by other sensors such as acoustic, noncontact sensors, optical sensors or the like. The sensor is a gauging sensor that provides for position control and provides a signal indicating deviation from a preset position that is used for controlling the actuator, in the form shown the piezoelectric actuator.

The use of the parallel hinge arrangement shown in FIGS. 3 through 6 is such that there is primarily translational movement only of the table relative to the base, and there is little vertical or height change in the normal adjustment movements. It should be noted that this table arrangement is not for large initial positioning movement, but is for controlling the precise position of the workpiece during machining operation after the workpiece has been located. The workpiece may be clamped to the table in any desired manner.

A piezoelectric actuator is easily adjustable precisely to correct for drift or change in its position. The position may change because of changing loads on the table, or because of changes in the voltage supply for the actuating voltage of the actuator. These changes cause slight shifts in the table relative to the table base which are sensed by the feedback sensor and correction is easily made.

Figure 2:
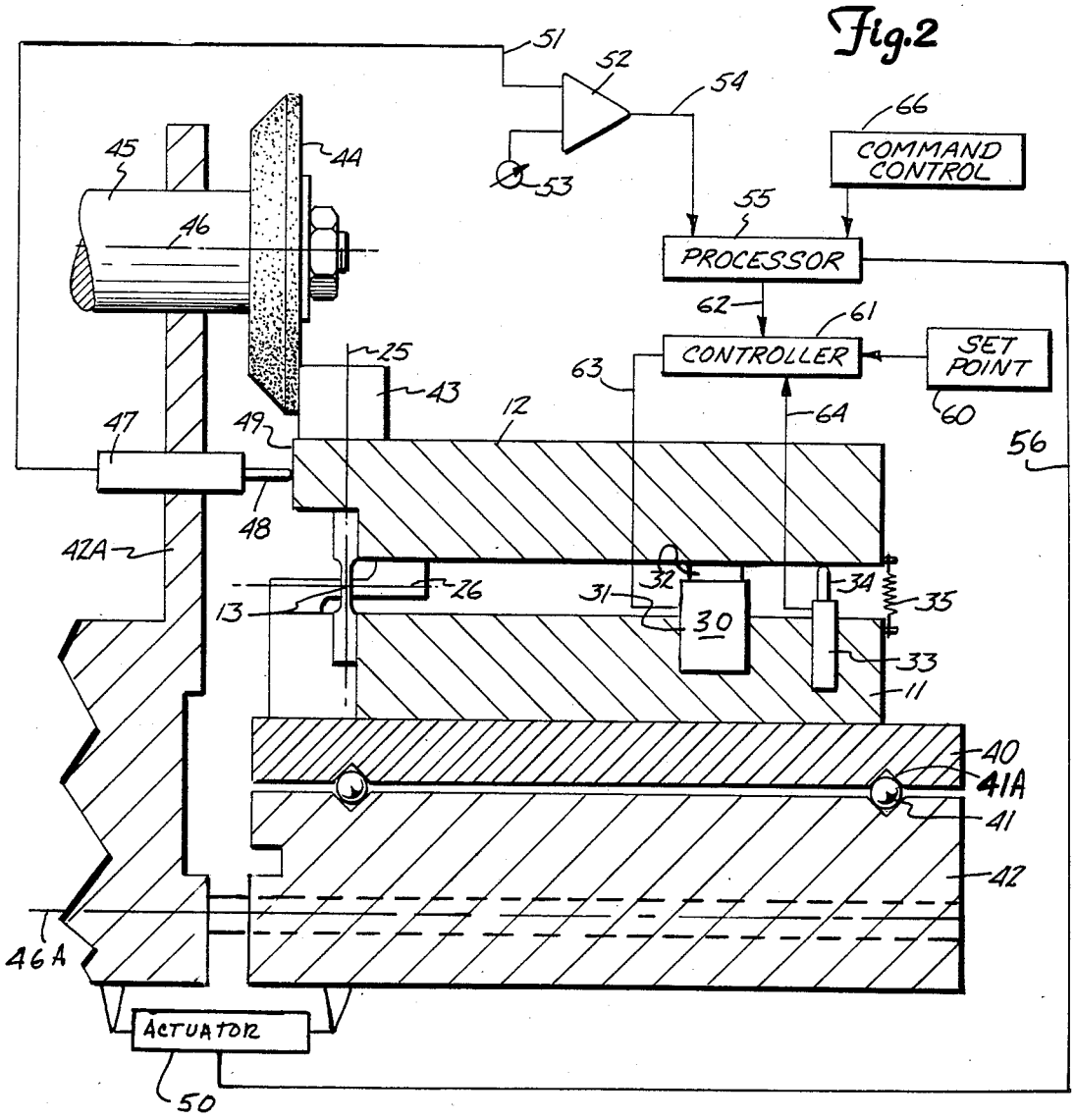
FIG. 2 is a part schematic sectional view of a machine tool base having the table shown in FIG. 1 supported thereon in relation to a grinding wheel and showing the control support actuator and feedback sensor in position.

The high accuracy and resolution is achieved because the support for the workpiece supporting table is friction free and backlash free, in its suspension relative to its base, and can be operated as a hinge, as shown in FIGS. 1 and 2, a parallelogram as shown in FIGS. 3 and 4, or as a combination of two parallelograms, which operate simultaneously to maintain the table in a parallel position to its original position with very little shift in height, but control its translational movement in the direction as indicated by the arrows in the figures.

Piezoelectric translators (actuators) are very stiff, and are capable of holding significant amounts of changing force, which is critical to accurate machining operations. The controls are straight-forward, and use the same principles of a feedback signal compared to a set signal as the controls used in servo hydraulic systems. In the present invention the control voltage is applied to the piezoelectric actuator, rather than a servovalve. The mechanical support for the table provides the ability to control the position to a very close tolerance. The piezoelectric actuator is available from Physik Instrumente of V7517, Wayvdrom, West Germany.

Although the present invention has been described with reference to preferred embodiments, workers skilled in the art will recognize that changes may be made in form and detail without departing from the spirit and scope of the invention.

What is claimed is:

1. An apparatus for controlling the positioning of an object comprising:

a table adapted to be supported in a desired position;

a table spaced from said table base; means for coupling said table to said table base comprising flat spring flexure means, said spring flexure means having flexure straps attached at opposite ends of the straps between said table and said table base and permitting movement of said table relative to said table base through said spring flexure means upon flexing of the spring flexure means;

means for establishing a reference position of the table relative to the table base at location spaced from said spring flexure means to directly control movement in at least one direction of movement of the table relative to the table base permitted by the spring flexure means; and means coupled to the table base and the table for sensing deviations in positions of the table from the reference position relative to table base and for providing a signal for adjusting the means for establishing a reference position.

2. The apparatus as specified in claim 1 wherein said means for establishing a reference position comprises a piezoelectric actuator having an element movable in response to voltage signals on the actuator, said means for sensing providing a voltage feedback signal, and means for controlling the position of said piezoelectric actuator in response to said feedback signal.

3. The apparatus as specified in claim 2 wherein said spring flexure means comprise crossed flexible straps including at least one flexible strap extending in a plane generally parallel to a table reference surface, a second flexible strap extending in a plane substantially perpendicular to the table reference surface, the planes of the flexible straps intersecting, and the line of intersection of said planes comprising a hinge axis for permitting hinging movement of the table relative to the table base.

4. The apparatus as specified in claim 3 wherein said piezoelectric actuator is spaced from said hinge axis and prevents movement of said table toward said table base about said hinge axis beyond a desired location.

5. The apparatus as specified in claim 1 wherein said spring flexure means comprise planar type flat straps connected between said table base and said table, and arranged to be substantially parallel in a rest position of the table, said flat straps moving as a parallelogram when the table translates relative to the table base in first and second directions perpendicular to the planes of said straps.

6. The apparatus as specified in claim 5 wherein said spring flexure means each comprise a pair of flat straps that are substantially parallel, and that are joined to each other at one end of the flat straps of each spring means, and one of the flat straps of each spring means being connected to one of the table base and table, respectively.

7. The apparatus as specified in claim 6 wherein said table base has upstanding end walls, the flat straps forming each spring means having first ends coupled together and each having a free end, the free end of one flat strap being attached to one of the end walls on the table base, and the other flat strap having its free end attached to an edge of the table.

8. The apparatus as specified in claim 5, wherein said table base is positioned spaced in relation to said table, a pedestal mounted on said table base and extending toward said table, a reaction wall fixed to said table and extending toward said table base and being laterally offset from said pedestal, said means for establishing and means for sensing being mounted on one of the pedestal and reaction wall for controlling the position between the pedestal and the reaction wall.

9. In a machine tool having a work tool spindle and a tool base and slide for movement relative to the tool spindle, the improvement comprising:

a table assembly and control system for controlling the positioning of a work piece relative to the work spindle including;

a table base adapted to be mounted on a tool base of a machine tool;

a table spaced from said table base and overlying at least a portion of the table base;

spring means for coupling said table to said table base and for forming at least one frictionless backlash free pivot axis that determines direction of movement of the table relative to the table base;

an actuator having a housing and an extendable actuator plunger, said actuator being mounted directly to the table and the table base so that movement of the actuator plunger will cause a reactive movement about said at least one pivot axis between the table and the table base;

first sensor means adapted to be mounted to sense position of the table relative to a work spindle in direction along the axis of such work spindle for sensing deviations of the table from a reference position in direction along such axis;

second sensor means mounted on the table base and table for sensing the position of the table relative to the table base; and control means responsive to both the first and second sensor means for controlling position of the table relative to the work spindle to a reference location and for adjusting the actuator to return the table to its reference position when deviations of the table relative to its reference position are sensed by the respective sensor means.

10. The apparatus as specified in claim 9 and second spring means operable between said table base and said table to urge the table and the table base toward its reference position controlled by the actuator plunger.

11. The apparatus as specified in claim 9 wherein said actuator comprises a piezoelectric actuator having the plunger movable in response to voltage signals on the actuator, said means for sensing providing a voltage feedback signal.

12. The apparatus as specified in claim 9 wherein said spring means comprise crossed spring elements that are substantially planar at a rest position, each of said elements being connected to the table base and table respectively at a position spaced from the actuator, said spring elements extending at substantially 90° to each other.

13. The apparatus as specified in claim 12 wherein there are two sets of crossed spring elements, said crossed spring elements of each set being connected adjacent the same end of the table, and each of the crossed spring elements being coupled between the table base and the table to form a single pivot axis generally adjacent one edge of the table, said spring elements in one set being spaced from the spring elements in the other set in direction along the pivot axis.

14. The apparatus as specified in claim 13 wherein the actuator is mounted on said table base, and the table rests against the plunger of the actuator under forces of gravity.

15. The apparatus as specified in claim 9 wherein said spring means comprise planar type flat springs connected between said table base and table, respectively, said springs being at opposite ends of said table base and table, respectively, and being substantially parallel to each other and perpendicular to the planes of the table and the table base.

16. The apparatus as specified in claim 9 wherein said spring means comprise two pairs of planar type flat springs, each pair of flat springs having first ends connected to each other, in a spaced apart relationship, and each pair having second ends connected one to the table base and one to the table, respectively, for permitting substantially parallel movement of said table relative to said table base in a direction along the plane of movement of said table relative to the base.

17. In a machine tool having a support frame and a tool base and slide for movement relative to the support frame, the improvement comprising:

a table assembly and control system for controlling the relative positioning of a member and work spindle member including;

a table base for mounting on a tool base of such a machine tool;

a table spaced from said table base and aligning with at least a portion of the table base;

means for coupling said table to said table base and for forming at least one frictionless backlash free pivot axis that determines direction of movement of the table relative to the table base;

an actuator having a housing and an extendable actuator plunger, said actuator being mounted directly between the table and the table base so that movement of the actuator plunger will cause a reactive movement about said at least one pivot axis between the table and the table base;

first sensor means adapted to be mounted to sense position of the table in direction along a work spindle axis relative to a machine tool frame on which the table assembly is mounted;

second sensor means mounted relative to the table base and table for sensing position of the table relative to the table base for controlling the actuator; and control means responsive to the first and second sensor means for controlling position of the table relative to the machine tool frame at a reference position in direction along the work spindle axis and for adjusting the actuator to return the table to its reference position when the table deviates therefrom.

18. The apparatus as specified in claim 17 wherein said first sensor means comprises a sensor adapted to be mounted on the machine tool for sensing position of a surface on the table.

* * * * *